US010252545B2

(12) United States Patent
Koers et al.

(10) Patent No.: US 10,252,545 B2
(45) Date of Patent: Apr. 9, 2019

(54) APPARATUS AND METHOD FOR PRINTING ON CONTAINERS

(71) Applicant: KHS GmbH, Dortmund (DE)

(72) Inventors: Sascha Koers, Bergkamen (DE); Markus Reiniger, Mönchengladbach (DE); Werner Van De Wynckel, Humbeek (BE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/770,819

(22) PCT Filed: Mar. 31, 2017

(86) PCT No.: PCT/EP2017/057659
§ 371 (c)(1),
(2) Date: Apr. 25, 2018

(87) PCT Pub. No.: WO2017/207131
PCT Pub. Date: Dec. 7, 2017

(65) Prior Publication Data

US 2018/0304644 A1 Oct. 25, 2018

(30) Foreign Application Priority Data

Jun. 3, 2016 (DE) ..... 10 2016 110 316

(51) Int. Cl.
*B41J 3/407* (2006.01)
*B41J 3/54* (2006.01)
*B65B 35/16* (2006.01)
*B41J 2/21* (2006.01)

(52) U.S. Cl.
CPC ..... *B41J 3/4073* (2013.01); *B41J 2/21* (2013.01); *B41J 3/543* (2013.01); *B65B 35/16* (2013.01)

(58) Field of Classification Search
CPC .. B41J 3/4073; B41J 3/543; B41J 2/21; B65B 35/16
See application file for complete search history.

(56) References Cited

FOREIGN PATENT DOCUMENTS

| | | | |
|---|---|---|---|
| DE | 10 2007 050 490 | 4/2009 | |
| DE | 10 2011 112 106 | 2/2013 | |
| DE | 10 2015 100 334 | 7/2016 | |
| WO | WO-2010034375 A1 * | 4/2010 | ..... B41J 3/4073 |

OTHER PUBLICATIONS

IP.com search (Year: 2018).*

* cited by examiner

*Primary Examiner* — Lisa Solomon
(74) *Attorney, Agent, or Firm* — Occhiuti & Rohlicek LLP

(57) ABSTRACT

A printing machine includes printing stations that each print a different color. The images printed by each printing station are superimposed on each other. Each printing station has a wireless interface for passing data to a successive printing station indicating where on the bottle the printing is to occur.

18 Claims, 3 Drawing Sheets

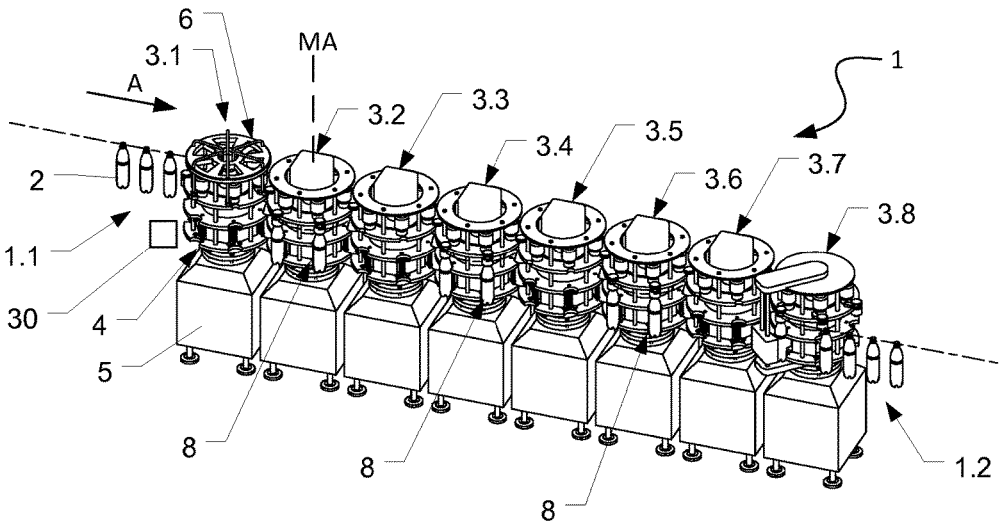
Fig. 1
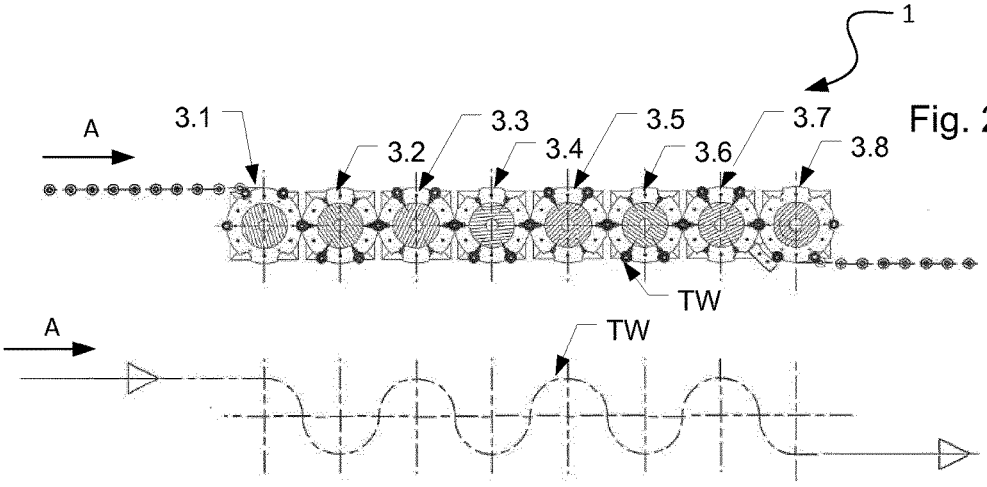
Fig. 2a
Fig. 2b

APPARATUS AND METHOD FOR PRINTING ON CONTAINERS

RELATED APPLICATIONS

This is the national stage under 35 USC 371 of PCT/EP2017/057659, filed on Mar. 31, 2017, which claims the benefit of the Jun. 3, 2016 priority date of German application DE 10 2016 110 316.0, the contents of which are herein incorporated by reference.

FIELD OF INVENTION

The invention relates to container processing, and in particular, to printing on containers.

BACKGROUND

It is known to print on containers with multiple colors. Usually, a different printing machine prints each color. This tends to increase throughput.

A difficulty that arises is registration of the images. If a first printing machine prints an image in a first color and a second printing machine prints in a different color, it is important that the two images be aligned. Otherwise the container will be unattractive.

SUMMARY

An object of the invention is to provide an apparatus for accurately printing on the correct locations on containers even at high processing speeds.

According to a first aspect, the invention relates to an apparatus for printing on containers. The apparatus comprises a container transport path on which the containers to be treated are moved in a transport direction from a container inflow to a container outflow. The container transport path comprises a plurality of transport elements, each having a plurality of printing stations. These transport elements can be driven so as to rotate about a vertical machine axis. At the printing stations the containers are held, centered and/or moved under control of a holding-and-centering unit.

In order to be printed upon, a container, together with its accompanying holding-and-centering unit, passes from a first transport element to a subsequent second transport element. A printing station of the first transport element defines a printing position and applies a first printed image portion onto the container.

The printing station has a wireless communication unit for direct wireless communication of a printing-position value from a printing station at the first transport element to a printing station at the second transport element. This value defines the printing position.

Examples of wireless communication units include wireless optical data units, and in particular, those that rely on infrared light. The printing station of the second transport element is configured to receive the value that defines the printing position, i.e., the printing-position value.

Alternatively both printing stations comprise corresponding optical transmitters and receivers. Such transmitters and receivers carry out optical point-to-point data transmission using light, including near-infrared light and light having wavelengths between 0.78 μm and 1.4 μm.

The printing station at the second transport element is also configured to print on a container's wall based on the received value defining the printing position.

The process of "defining a printing position" can be deterministic or non-deterministic.

In the deterministic case, the location where the printing of the container is to take place is determined before the container is printed upon. This can occur, for example, by having a rotary position value that has been defined to be the value at which the image, or a particular point or portion thereof, is printed.

In the non-deterministic case, the first image portion is printed upon the container at a random position. This random position then determines the printing-position value for communication to subsequent printing stations.

An advantage of the printing apparatus is that the communication of the value defining the printing position, i.e., the "printing-position value," does not rely on a central machine network through which a large number of printing stations communicate their respective printing-position values. Instead, the communication of the printing-position value relies on targeted direct communication of the printing-position value from one printing station directly to the next. This avoids delays caused the bottleneck of a central location and thereby improves the process of printing images that are made by superimposition of multiple image portions.

In some embodiments, the apparatus for defining a printing position is configured individually for each container held at a holding-and-centering unit and for the targeted communication of a printing-position value defining the printing position for that container to the printing stations that are printing on that particular container. As a result, for every combination of holding-and-centering unit and container held on it, the printing-position value that is valid for that combination is defined and communicated to the printing stations.

In particular, the apparatus is configured for the targeted communication of the printing-position value only to those printing stations at which the printing of that particular container takes place. The targeted communication of the printing-position value to the printing stations performing the printing of the container sharply reduces the amount of data that is to be transmitted.

In some embodiments, the holding-and-centering unit comprises an encoding for determining the rotary orientation of the container held at the holding-and-centering unit. The encoding can be provided at a section of the holding-and-centering unit that rotates with the container. A value of the encoding or a value derived from the encoding is communicated as the printing-position value. At each printing station therefore, based on the encoding, the container can be moved into a desired rotary position determined by the printing-position value and can then be printed upon while it is in that position.

In some embodiments, an optical communication interface forms the communication unit at a printing station. Among these are embodiments in which the optical communication interface is an infrared communication interface. An infrared communication interface is particularly useful because it works reliably even in the presence of interfering outside influences, such as interfering electromagnetic radiation. This promotes reliability.

In some embodiments, the printing stations are configured to carry out face-to-face communication. Such embodiments communicate the printing-position value at a time when a printing station of the first transport element and a printing station of the subsequent transport element are immediately adjacent to and stand facing one another for the transfer of the container that is to be printed upon. When the printing stations face one another, their front sides arranged on the outer periphery are adjacent to one another or directly face one another so as to be able to transfer the holding-and-centering unit from one printing station to the next printing station. This "facing one another" position can be used to communicate the information about the printing-position value selectively by way of a short-range communication unit. Specifically, the infrared communication interfaces provided at the respective printing stations face one another directly so that the information about the printing-position value can be communicated from one printing station to the next.

In some embodiments, the printing stations are interchangeable printing modules that can be swapped in and out as a whole. Each printing modules contains all of the functional elements needed for printing on the containers. Each printing module can also be calibrated beforehand.

In some embodiments, the printing station comprises a storage unit for storing calibration information with which the printing module can be calibrated after it has been mounted in the apparatus. This improves the maintainability of the apparatus and reduces downtimes arising from having to repair defects.

In some embodiments, each printing module comprises a communication unit for transmitting and receiving the printing-position value. As a result, each printing module receives the printing-position value that it needs to orient the container and that it will pass on to the following printing module.

In some embodiments, each printing module comprises an infrared transmitter and an infrared receiver for communicating the printing-position value. Using the infrared receiver, the infrared transmitter receives the printing-position value from a printing module that is upstream in the transport direction. Using the infrared transmitter, communicates this printing-position value onward to a downstream printing module.

In some embodiments, the printing modules comprise at least one printing head and a mounting for holding and then releasing a holding-and-centering unit. In some embodiments, the mounting station includes an electromagnet. The printing modules therefore comprise all components required both to accurately position and secure a container and for printing on the container.

In some embodiments, the printing modules each comprise a housing or a support element configured for the detachable coupling of a transport element using a support structure. In particular, a quick-acting connection mechanism can be provided that is configured for the accurate positioning of the printing module on the support structure and to simplify interchangeability of the printing modules. This again improves the maintainability of the apparatus.

In some embodiments, the printing modules are fixed adjacent to one another around the periphery of the transport element. In some of these embodiments, the printing modules form a printing-module circle around the outer periphery on the transport element and on which printing stations are formed by each of the printing modules.

In some embodiments, a printing module comprises at least one interface that is configured for coupling with at least one corresponding interface provided on the transport element for supplying the printing module with electrical energy and printing ink and also for communicating control information. In some embodiments, a single interface establishes the electrical and fluid coupling between the printing module and the transport element. In other embodiments, plural interfaces do the same thing. In some of these embodiments, a first interface provides electrical energy and control information and a second interface provides the printing ink. As a result, mechanical attachment of the printing module to the transport element ensures a supply of power and fluid to the printing module at the same time.

According to a further aspect, the invention relates to a method for printing on containers using a printing apparatus, with the method comprising positioning a container at a holding-and-centering unit; defining a printing position in a printing station of a first transport element; printing on the container with an image portion at the printing station of the first transport element based on the defined printing position; passing the container held at the holding-and-centering unit from the printing station of the first transport element to a printing station of a second transport element; communicating a value defining the printing position from the printing station of the first transport element to a printing station of the second transport element by a wireless communicator; and printing on the container with a further image portion at the printing station of the second transport element at a printing position defined by or derivable from the communicated printing-position value.

In some practices of the method, the value defining the printing position is communicated by way of an infrared communication interface. This takes place when the printing station of the first transport element and the printing station of the second transport element face one another during a transfer of the container that is to be printed on. During the container-transfer operation, therefore, the printing-position value can also be communicated.

As used herein, the term "container" includes bottles and cans.

As used herein, expressions such as "substantially" or "around" mean variations from the respective exact value by ±10%, preferably by ±5% and/or variations in the form of changes that are insignificant for function.

Further embodiments, advantages and possible applications of the invention arise out of the following description of embodiments and also out of the figures. All of the described and/or pictorially represented attributes, whether alone or in any desired combination, are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of embodiment examples with reference to the figures. In the figures:

FIG. 1 shows a perspective view of a printing apparatus;

FIG. 2*a* shows a plan view of the printing apparatus of FIG. 1;

FIG. 2*b* shows a transport path through the printing apparatus shown in FIGS. 1 and 2;

DETAILED DESCRIPTION

Figure 3:
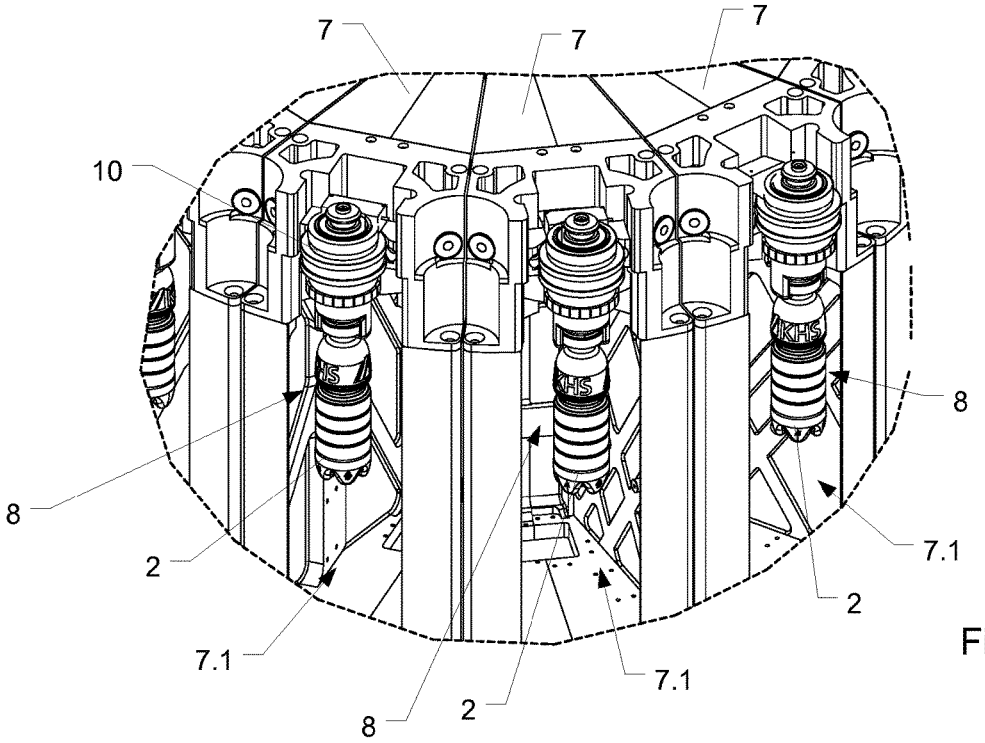
FIG. 3 shows a perspective view of printing modules arranged on a transport element.

FIG. 1 shows a printing apparatus 1 that prints on containers 2, such as bottles and that does so either directly on the containers' walls or onto labels that have already been fixed on the containers 2.

An external transporter feeds the upright containers 2 along a transport direction A and through a container inlet 2.1 into the apparatus 1. Once in the apparatus 1, the containers 2 move along a conveyor section on a meandering sinuous path TW as shown in FIGS. 2*a* and 3*b*. After having been printed upon, an external transporter feeds the containers 2, which are still upright, to a subsequent use. This occurs at a container outlet 1.2.

The apparatus 1 includes machine units 3.1-3.8 arranged one after the other along the transport direction A. The particular embodiment shown has eight machine units 3.1-3.8. However, different embodiments can have different numbers of machine units.

Each machine unit 3.1-3.8 has the functional elements necessary for its particular task. The chain of machine units 3.1-3.8 can include more machine units or fewer machine units depending on printing requirements.

The machine units 3.1-3.8 have identical base units 4. Each base unit 4 comprises a housing 5 that supports a transport element 6, or rotor. The housing 5 accommodates a drive and control unit. The drive and control unit rotates the transport element 6 about a vertical machine axis MA of the machine unit 3.1-3.8. It does so either continuously or intermittently.

The transport element 6 has identical treatment modules disposed around a periphery thereof. These treatment modules correspond to the machine unit's function. Examples of treatment modules include those for pre-treatment or sterilization, those for printing, those for curing, and those for inspection.

A holding-and-centering unit 10 accompanies a container 2 as it makes its way through the various machine units 3.1-3.8. Each treatment module of a machine unit has a mount for engaging and disengaging a holding-and-centering unit 10 that passes through the apparatus.

The transport elements 6 of individual machine units 3.1-3.8 are arranged adjacent to one another. Transport elements 6 of adjacent machine units 3.*n*, 3.(*n*+1) rotate synchronously in opposite directions. As a result, the transport elements 6 collectively move the containers 2 from a container inflow 1.1 to the container outflow 1.2 along the serpentine transport path TW shown in FIG. 2*b*.

The individual containers 2 are each transferred directly from the transport element 6 of one machine unit 3.*n* to the transport element 6 of that machine unit 3.(*n*+1) that follows it in the transport direction A.

The first machine unit 3.1 carries out pre-treatment of the containers 2 in the region that is to be printed upon. Examples of such treatment include plasma or corona treatment. The second through sixth machine units 3.2-3.6 that follow the first machine unit 3.1 are the actual printing units. Each printing unit prints a different color. The seventh machine unit 3.7 is a drying unit that dries or cures the ink for example by applying UV or thermal radiation. The eighth machine-unit 3.8 provides the container outflow 1.2 through which containers 2 that have been printed upon exit the apparatus 1. In some embodiments, the eighth machine unit 3.8 is a drying module. In some embodiments, the machine units also include an inspection unit.

As FIG. 2*b* shows, a container 2 being carried by a transport element 6 at either end of the chain of machine units 3.1-3.8, namely the first and eighth machine units 3.1, 3.8, moves over an angular range of approximately 90° about the vertical machine axis MA. A container 2 that is being carried by a transport element 6 on any other machine element 3.2-3.7 moves over an angular range of 180° about the vertical machine axis MA. The second through seventh machine units 3.2-3.7 therefore carry out whatever process is assigned, whether it be pre-treatment, printing, or curing, within this angular range.

Figure 4:
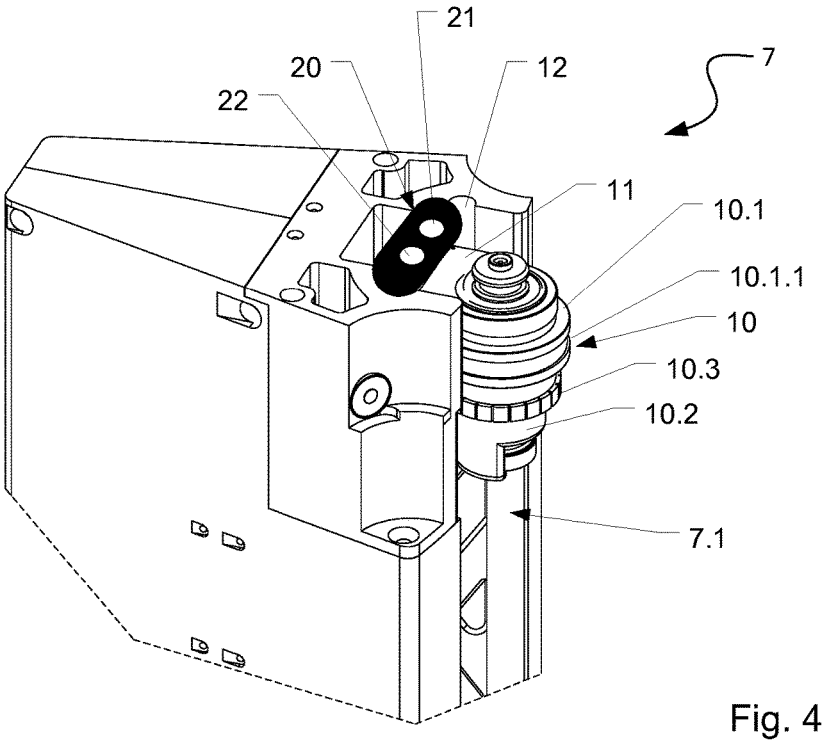
FIG. 4 shows a perspective view of a printing module with a holding-and-centering device arranged thereon.

Referring to FIGS. 3 and 4, the treatment unit of each machine unit 3.1-3.8 is configured as a treatment module or as a treatment segment. These treatment modules, or segments, are interchangeably mounted as complete functional units on a rotor of the machine unit 3.1-3.8. As such, they can be swapped in and out as a unit.

As shown in FIG. 3, the treatment modules, one of which can be seen in FIG. 2, are contiguous around the periphery of the rotor. Viewed from above, each treatment module is shaped like a piece of cake or a wedge. Each treatment module has a side that faces radially outward relative to the machine axis MA. A recess 7.1 on this radially-outward side receives a holding-and-centering unit 10 that suspends a container 2 from a region around its mouth.

Referring to FIG. 4, at the top of the recess 7.1 is a carrier 11 that holds the holding-and-centering units 10. The carrier 11 is fastened in associated lateral keyways 12. As an option, the carrier 11 can be moved or pushed in the keyways 12. In such cases, a suitable driver drives the carrier 11 as if it were a carriage. This enables the treatment module to adapt to different container formats.

In addition to holding and centering a container 2, the holding-and-centering unit 10 carries out controlled rotating and/or pivoting of the container 2. To facilitate this function, the holding-and-centering unit 10 includes a primary part 10.1 and a secondary part 10.2.

The primary part 10.1 engages the carrier 11. Its role is to secure the holding-and-centering unit 10 to the treatment module in the correct orientation. To achieve this, the primary part 10.1 comprises, among other things, a reference surface 10.1.1. A complementary counterpart to this reference surface 10.1.1 on the treatment module 7 serves as a reference plane or reference surface for contact and hence for adjustment relative to the treatment devices provided on the treatment module. This creates a fixed common reference between the holding-and-centering unit 10, or the container 2, and the treatment devices.

In some embodiments, a passive force holds the primary part 10.1 to the carrier 11 and an active force removes or releases it. This promotes safety in case of power loss. A suitable passive force is a magnetic force applied by one or more permanent magnets.

The secondary part 10.2 suspends the container 2. To achieve this, the secondary part 10.2 is configured like a gripper. Examples of grippers include mechanical grippers, pneumatically actuated grippers, and vacuum grippers.

The secondary part 10.2 comprises active components needed for aligning and controlled rotating or pivoting of the containers 2 during treatment. Examples of such components would include components for aligning and/or rotating the packaging elements during printing and/or components for supplying compressed air and/or vacuum.

The secondary part 10.2 mounts to the primary part 10.1 so as to be able to rotate or pivot about a printing segment axis DA. In the illustrated embodiment, the secondary part 10.2 is a rotor of an electrical drive for causing controlled movement of the container 2 during treatment thereof. Such controlled movement includes aligning, carrying out controlled rotation, and carrying out controlled pivoting.

To facilitate functioning as a rotor, the secondary part 10.2 includes a magnet array 10.3 having a plurality of permanent magnets. Along its peripheral direction, the magnet array 10.3 has alternating north and south poles. The magnet array 10.3 interacts with an array of electromagnets provided on the carrier 11. This array of electromagnets forms the drive's stator. The drive is thus an electromagnetic direct drive.

An encoder on the primary part 10.1 interacts with an incremental sensor on the treatment module to provide information from which the random orientation of the primary part 10.1 can be determined. This provides information on the orientation of the holding-and-centering unit 10. Such information informs the controlled movement of the container 2 during container treatment thereof. The information provides a relationship between the primary part 10.1 and the secondary part 10.2. During controlled rotation, only the secondary part 10.2 rotates. The primary part 10.1 remains stationary.

Some embodiments have an encoder system that is associated with the secondary part 10.2. This secondary-part encoder system permits determination of the rotary orientation of the secondary part 10.2 or of the container 2. In some embodiments, the secondary-part encoder-system is an absolute encoder system that provides information from which the absolute orientation of the secondary part 10.2 or of the container 2 can be determined. Controlled orientation or rotation of a container 2 about its vertical axis is carried out relative to the treatment module or a functional element at the treatment module.

A multi-colored image is a superposition of several single-color component images. Each of the second through sixth machine units 3.2-3.6 prints one of these single-color component images. It is therefore important that these single-color component images be superimposed correctly on each other.

A printing station 8 at the second machine unit 3.2 prints the first of several single-color component images. These will also be referred to herein as "image portions."

To accurately superimpose these component images on each other, it is useful for a printing station 8 on the second machine unit 3.2 to define a printing position on the basis of which printing is carried out not only on the second machine unit 3.2 but on all subsequent machine units that are designated for printing other single-color image components.

The process of defining the printing position begins with second machine unit 3.2 printing on the container 2 while the container 2 is at a random orientation. Recording this random orientation defines the printing-position value. In some embodiments, an encoding value of the encoder system of the holding-and-centering unit 10 defines the printing-position value. This encoding value maps to the rotary orientation of the container. In other embodiments, the printing-position value is a value derived from the encoder system.

The printing-position value therefore indicates the rotary orientation in which the container has been printed upon and/or the orientation in which the image has been arranged. The printing-position value can, for example, indicate where the edge of an image begins. Or, it can specify the position at which a certain region of the image, such as the image's center, comes to rest.

The printing-position value is not defined on the basis of a determined container feature. It does not rely on the position of an embossing, the position of a container seam, or the position of any particular feature on the container. Rather, the printing-position value is defined independently of the container. Its value is determined arbitrarily, either at random or by selecting a particular encoding value of the encoder system.

This printing-position value, which has been defined in the second machine unit 3.2, is communicated to the third through sixth machine units 3.3-3.6 so that they can use it in connection with correctly superimposing the remaining image portions.

The third through sixth machine units 3.2-3.6 each comprise printing modules 7. A quick-release locking system attaches the printing modules 7 to a support structure of the transport element 6 of the machine unit 3.2-3.6. As a result, printing modules 7 can be interchanged as a whole.

Each printing module 7 includes a printing head and a mount that holds and releases the holding-and-centering unit 10. The printing module 7 includes a housing in or on which all functional elements that are necessary for container printing are provided. Examples of such functional elements include an ink-supply system, a print-head adjusting mechanism, and a memory for storing calibration data associated with the print head. In some embodiments, the printing module 7 includes one or more interfaces that interact with corresponding interfaces on the transport element 6 once the printing module 7 has been mounted on the transport element 6. These interfaces ensure a ready supply of ink, electricity, and control data to the printing module 7.

In the case of the printing apparatus 1 shown in FIG. 1, the printing position is defined at the second machine module 3.2, which is the first machine module that is actually configured for container printing. It is here that a printing-position value relative to which the image is arranged is defined or determined. To enable this printing-position value to be communicated to the third through sixth machine units 3.3-3.6, which apply further image portions, the printing modules 7 comprise wireless short-range communication units 20 for communicating the printing position-value. An example of such a short-range communication unit 20 is an infrared communication interface.

The printing-position value is communicated selectively between the printing modules 7. As a result, a printing module 7 that is printing on a particular container at a particular machine unit 3.*i* will transmit the printing-position value only to the printing module 7 on the next machine unit 3.(*i*+1) that will be printing on the same container 2. The remaining printing modules 7 on the next machine unit 3.(*i*+1) will not receive this printing-position value.

For example, a printing module 7 of the second machine unit 3.2 communicates the printing-position value to a printing module 7 of the third machine unit 3.3, which follows in transport direction A. This printing module 7 then communicates the same printing-position value to a printing module 7 of the fourth machine unit 3.4. This procedure continues down the line.

The information is preferably communicated at the same time as the transfer of the holding-and-centering unit 10 between a machine unit 3.*i* and its successor machine unit 3.(*i*+1). At this moment, the two printing modules 7 from the two different machine units 3.*i*, 3.(*i*+1) will be facing one another.

The direct communication of the printing-position value between individual printing modules 7 avoids burdening a machine network that interconnects the machine units 3.1-3.*n*. Such direct communication also avoids time-critical communication between rotating printing modules 7 and the static machine parts. This ensures timely communication of printing-position values even at a high container throughput.

In some embodiments, the communication unit 20 is on the front of the printing module 7. A typical communication unit 20 includes an infrared transmitter 21 and an infrared receiver 22. The infrared transmitter 21 communicates the printing-position value to another printing module 7 with the aid of the infrared transmitter 21. The infrared receiver 22 enables a printing-position value from a transmitting printing module 7 to be received and appropriately used in a receiving printing module 7. In particular, when the printing-position value is received, the container 2 can be rotated based on the received printing-position value to superimpose the next image portion to be printed on the image portion that already exists on the container 2.

Figure 5:
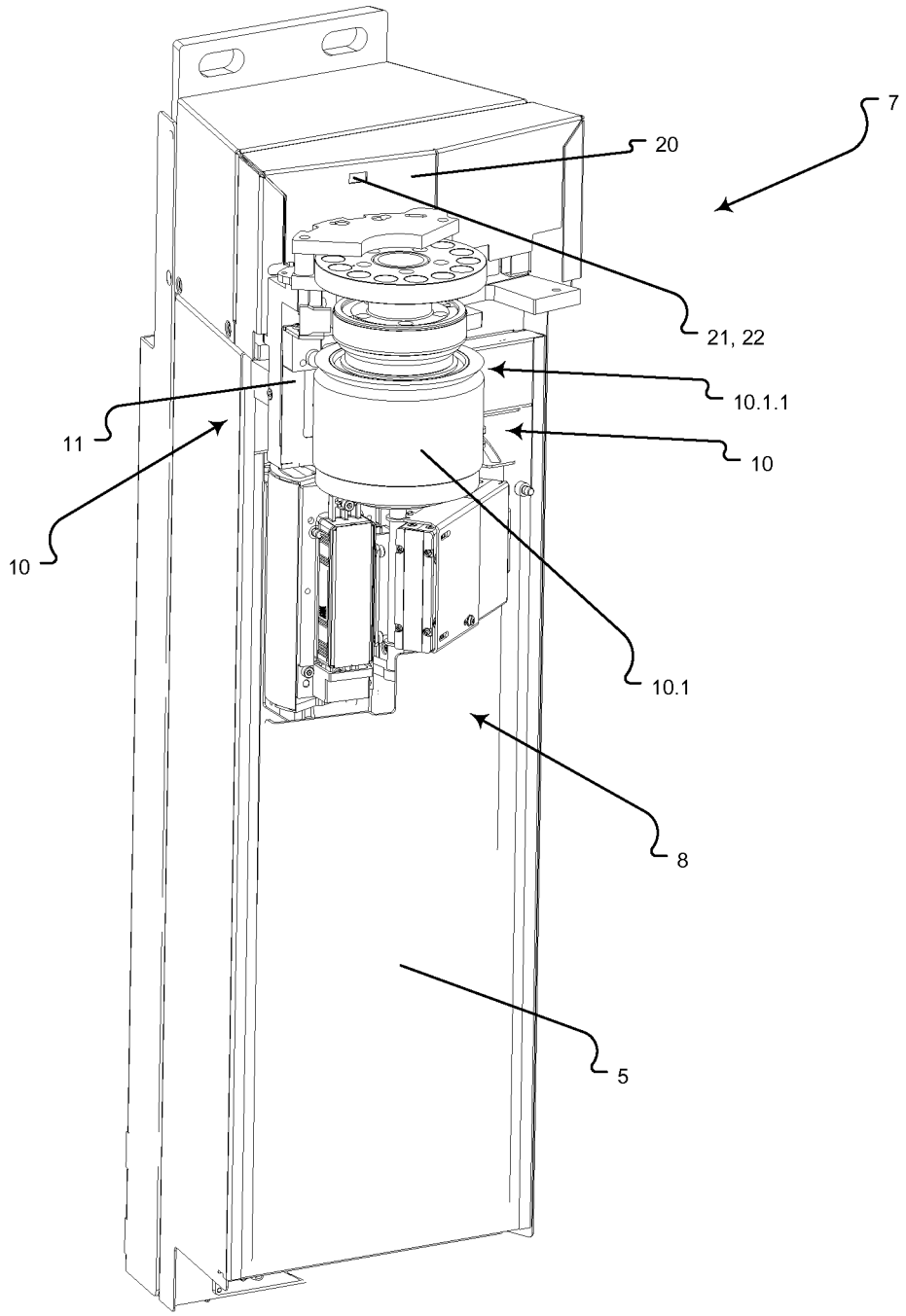
FIG. 5 shows a perspective view of a printing module that differs from that shown in FIG. 4 and that has a holding-and-centering device arranged thereon.

The printing module 7 according to FIG. 5 comprises a somewhat different mounting of the holding-and-centering unit 10. The reference faces of the primary part 10.1 are executed as a circumferential keyway that is brought into contact with at least two centering pins. The communication unit 20, which is arranged above the carrier 11, comprises only one opening for an infrared transmitter 21 and an infrared receiver 22.

Embodiments include those in which communicators rely on infrared communication interfaces that operate in the IR-A wavelength range of 850-900 nanometers. Alternatively, other optical communication interfaces can be provided.

The invention has been described hereinbefore by reference to particular embodiments. However, variations or modifications are possible without departing from the inventive concept underlying the invention as expressed by the accompanying claims.

The invention claimed is:

1. An apparatus for printing on containers, said apparatus having a container transport path on which said containers to be printed upon are moved from a container inflow to a container outflow along a transport direction, wherein said container transport path is formed by a plurality of transport elements, each of which can each be driven so as to rotate about a vertical machine axis, wherein each transport element has a plurality of printing stations on which containers are held, centered and/or moved under control by a holding-and-centering unit, wherein said containers, in order to be printed upon, are passed together with said holding-and-centering unit, from a first transport element to a subsequent second transport element or, on the same transport element, from a first printing station to a second printing station, wherein said printing stations of a first transport element comprise means for defining a printing position, with a first image-portion being printed on said containers at said printing stations of said first transport element, wherein communication means are provided at said printing stations of said transport elements for wireless communication of a value defining said printing position from a printing station of said first transport element to a printing station of said second transport element, wherein said printing station of said second transport element is configured to receive said value defining said printing position, wherein said printing station of said second transport element is configured to print, on said container, on a container wall region and to do so based on said received value defining said printing position.

2. The apparatus of claim 1, wherein said means for defining a printing position is configured individually for each container held at a holding-and-centering unit, wherein said printing-position value defines said printing position for printing stations that print on said container.

3. The apparatus of claim 1, wherein said apparatus is configured for targeted communication of said printing-position value only to those printing stations at which printing of said container takes place.

4. The apparatus of claim 1, wherein said holding-and-centering unit comprises an encoding for determining a rotary orientation of said container held at said holding-and-centering unit and wherein a value of said encoding or a value derived from said encoding can be communicated as said printing-position value.

5. The apparatus of claim 1, wherein said communication means provided at said printing station is formed by an infrared communication interface.

6. The apparatus of claim 1, wherein said printing stations are configured in such a way that said printing-position value can be communicated at a time when a printing station of said first transport element and a printing station of said subsequent or of said same transport element are immediately adjacent to and stand facing one another for transfer of said container that is to be printed on.

7. The apparatus of claim 1, wherein said printing stations are formed by printing modules, each of which is interchangeable as a whole.

8. The apparatus of claim 7, wherein each printing module comprises communication means for transmitting and receiving said printing-position value.

9. The apparatus of claim 7, wherein each printing module comprises an infrared transmitter for transmitting said printing-position value and an infrared receiver for receiving said printing-position value.

10. The apparatus of claim 7, wherein each of said printing modules comprises a printing head and means for holding and then releasing a holding-and-centering unit.

11. The apparatus of claim 7, wherein each of said printing modules comprises a housing or a support element configured for detachable coupling with a support structure of a transport element.

12. The apparatus of claim 7, wherein said printing modules are fixed adjacent to one another around a periphery of said transport element.

13. The apparatus of claim 7, wherein each of said printing modules comprises at least one interface that is configured for coupling with at least one corresponding interface provided on said transport element for supplying said printing module with electrical energy and printing ink and for communicating control information.

14. A method for printing on a container using a printing apparatus that applies of at least two image portions in different colors on said container, said method comprising positioning said container at a holding-and-centering unit, defining a printing position at a printing station of a first transport element, printing an image portion on said container at said printing station of said first transport element, passing said container, which is held at said holding-and-centering unit, from said printing station of said first transport element to a printing station of a second transport element, communicating a printing-position value, which defines a printing position and which is relevant for a following image-portion, from said printing station of said first transport element directly to a printing station of said second transport element by wireless communication means, and printing, upon said container, a further image-portion at said printing station of said second transport element at a printing position defined by or derivable from said communicated printing-position value.

15. The method of claim 14, wherein said printing-position value is communicated by way of an infrared communication interface when said printing station of said first transport element and said printing station of said second transport element face one another to transfer said container that is to be printed on.

16. The method of claim 15, wherein said printing-position value comprises an encoding of said holding-and-centering unit for determining rotary orientation thereof and wherein a value of said encoding or a value derived from said encoding is communicated as said printing-position value.

17. The method of claim 14, wherein said printing-position value describes a relative positional relationship between said first image-portion and said second image-portion.

18. The method of claim 14, wherein, for capture, determining, and/or communication of said printing-position value, no sensory capture of a surface region of said container occurs and/or no capture of an optical feature of said container by an image recording device occurs.

* * * * *